US010718079B2

(12) United States Patent
Ramasco et al.

(10) Patent No.: US 10,718,079 B2
(45) Date of Patent: Jul. 21, 2020

(54) COUPLING SYSTEM OF REMOVABLE COMPARTMENT FOR APPLIANCES

(71) Applicant: WHIRLPOOL S.A., Sao Paulo (BR)

(72) Inventors: Bruno T. Ramasco, Stevensville, MI (US); Guilherme Henrique Manzi, Americana (BR)

( * ) Notice: Subject to any disclaimer, the term of this patent is extended or adjusted under 35 U.S.C. 154(b) by 228 days.

(21) Appl. No.: 15/831,912

(22) Filed: Dec. 5, 2017

(65) Prior Publication Data

US 2018/0094375 A1 Apr. 5, 2018

Related U.S. Application Data

(63) Continuation of application No. 14/786,666, filed as application No. PCT/BR2014/000323 on Sep. 9, 2014, now Pat. No. 9,863,078.

(30) Foreign Application Priority Data

Oct. 24, 2013 (BR) ..... 10 2013 027400

(51) Int. Cl.
*D06F 1/12* (2006.01)
*D06F 37/12* (2006.01)
(Continued)

(52) U.S. Cl.
CPC ..... *D06F 37/16* (2013.01); *D06F 1/12* (2013.01); *D06F 37/12* (2013.01); *D06F 37/245* (2013.01); *D06F 95/002* (2013.01)

(58) Field of Classification Search
CPC . D06F 1/12; D06F 37/12; D06F 37/16; D06F 37/245; D06F 95/002
See application file for complete search history.

(56) References Cited

U.S. PATENT DOCUMENTS 1,795,395 A 3/1931 Hoke
2,748,788 A 6/1956 Duckstein
(Continued)

FOREIGN PATENT DOCUMENTS

BR DI7003246-7 10/2011
BR 102013015674 A2 7/2015
(Continued)

OTHER PUBLICATIONS

Machine translation of KR-20030045447-A. (Year: 2003).*
(Continued)

*Primary Examiner* — Joseph L. Perrin
(74) *Attorney, Agent, or Firm* — McGarry Bair PC

(57) ABSTRACT

The present invention relates to a coupling system for fitting and attaching of a removable internal basket for a washing machine. The washing machine comprises a removable washing compartment configured to be mounted in the washing machine. The washing machine includes at least one convex protrusion or at least one concave groove across a portion of an inner side surface, and the removable washing compartment includes the other of at least one convex protrusion or at least one concave groove across a portion of an outer side surface. The balancing device includes a smooth surface portion across a portion of the inner side wall and the removable washing compartment includes a complimentary smooth surface portion across a portion of an outer side surface. When the removable washing compartment is mounted in the washing machine, the smooth surface portion on the inner side wall aligns with the smooth surface portion on the outer surface of the removable washing compartment and the at least one convex protrusion nests with the at least one concave groove such that the surface of the convex protrusion contacts the surface of the concave groove.

16 Claims, 5 Drawing Sheets

(51) Int. Cl.

| | |
|---|---|
| ***D06F 95/00*** | (2006.01) |
| ***D06F 37/24*** | (2006.01) |
| ***D06F 37/16*** | (2006.01) |

(56) References Cited

U.S. PATENT DOCUMENTS

| | | | | |
|---|---|---|---|---|
| 3,014,358 | A | | 12/1961 | Bochan |
| 3,026,699 | A | | 3/1962 | Rhodes |
| 3,029,623 | A | | 4/1962 | Morey |
| 3,145,551 | A | | 8/1964 | Ziegler |
| 3,209,560 | A | | 10/1965 | Shelton |
| 3,324,688 | A | * | 6/1967 | Hubbard ..... D06F 13/00 68/4 |
| 3,481,162 | A | | 12/1969 | Ziegler |
| 3,509,741 | A | | 5/1970 | Morey |
| 3,575,020 | A | | 4/1971 | Hubbard |
| 3,648,486 | A | | 3/1972 | Rosinski, Jr. et al. |
| 3,987,652 | A | | 10/1976 | Ruble |
| 4,118,957 | A | | 10/1978 | Marcussen |
| 4,162,621 | A | | 7/1979 | Stone |
| 4,175,409 | A | | 11/1979 | Morey |
| 4,186,573 | A | | 2/1980 | Brenner |
| 4,207,760 | A | | 6/1980 | Bochan |
| 4,225,992 | A | | 10/1980 | Morey |
| 4,338,802 | A | | 7/1982 | Ohmann et al. |
| 4,637,230 | A | | 1/1987 | Roberts |
| 4,637,231 | A | | 1/1987 | McMillan et al. |
| 4,920,770 | A | | 5/1990 | Dooley et al. |
| 5,113,542 | A | | 5/1992 | Pastryk et al. |
| 5,440,903 | A | | 8/1995 | Kropf et al. |
| 5,497,638 | A | | 3/1996 | Berkcan |
| 5,611,221 | A | | 3/1997 | Tremel |
| 5,689,847 | A | | 11/1997 | Tremel et al. |
| 5,784,902 | A | | 7/1998 | Pinkowski et al. |
| 6,460,382 | B1 | | 10/2002 | Kim et al. |
| 7,401,479 | B2 | | 7/2008 | Fields |
| 7,866,191 | B2 | | 1/2011 | Turner et al. |
| 9,404,213 | B2 | | 8/2016 | Kappler |
| 2004/0116267 | A1 | | 6/2004 | Mathieu et al. |
| 2005/0284197 | A1 | | 12/2005 | Pinkowski et al. |
| 2007/0084254 | A1 | | 4/2007 | Messina |
| 2009/0211108 | A1 | | 8/2009 | Moschutz et al. |
| 2009/0293203 | A1 | | 12/2009 | Hettinger et al. |
| 2011/0094902 | A1 | | 4/2011 | Delehey et al. |
| 2013/0276483 | A1 | | 10/2013 | Ryu et al. |
| 2013/0312462 | A1 | | 11/2013 | Kim et al. |
| 2015/0059417 | A1 | | 3/2015 | Ramasco |
| 2015/0184326 | A1 | | 7/2015 | Pyo |
| 2015/0211163 | A1 | | 7/2015 | Jeon |
| 2016/0201243 | A1 | | 7/2016 | Bergamo |
| 2016/0222567 | A1 | | 8/2016 | Manz |
| 2016/0289884 | A1 | | 10/2016 | Kim et al. |
| 2019/0186064 | A1 | | 6/2019 | Kim et al. |

FOREIGN PATENT DOCUMENTS

| | | | | |
|---|---|---|---|---|
| BR | 102013018364 | A2 | | 8/2015 |
| BR | 102013021866 | A2 | | 8/2015 |
| BR | 102013015672 | A2 | | 9/2015 |
| BR | 102013027400 | A2 | | 9/2015 |
| BR | 102013025343 | A2 | | 11/2015 |
| BR | 102014008903 | A2 | | 12/2015 |
| BR | 102014010905 | A2 | | 12/2015 |
| BR | 102014010908 | A2 | | 12/2015 |
| BR | 102014018397 | A2 | | 2/2016 |
| CN | 203530690 | U | | 4/2014 |
| CN | 203729101 | U | | 7/2014 |
| CN | 105220395 | A | | 1/2016 |
| KR | 20030045447 | A | * | 6/2003 |
| WO | 2013088426 | | | 6/2013 |
| WO | 2014201534 | A1 | | 12/2014 |
| WO | 2015048870 | A1 | | 4/2015 |
| WO | 2015058269 | A1 | | 4/2015 |

OTHER PUBLICATIONS

International Search Report and the Written Opinion of the International Search Authority for International Application No. PCT/BR2014/000323 dated May 1, 2015.

* cited by examiner

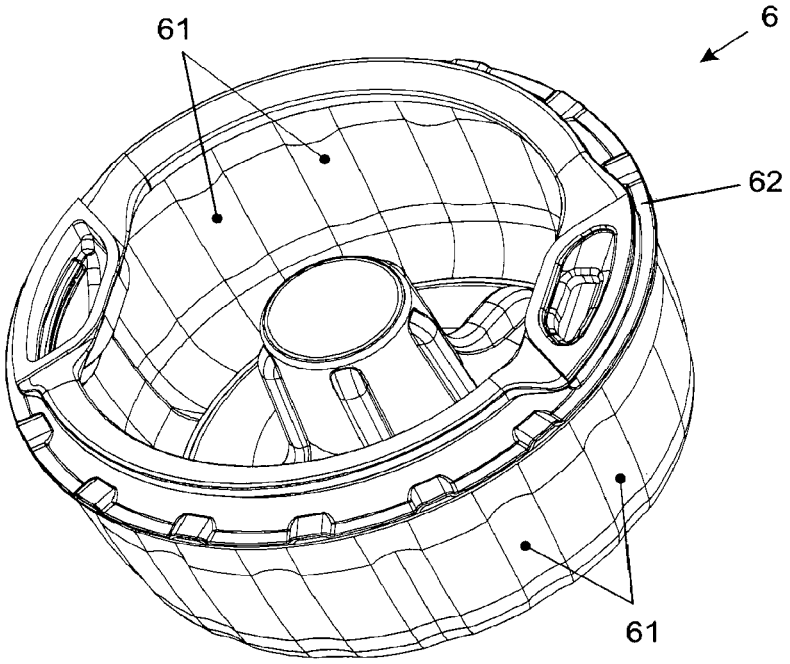
FIG.1.1
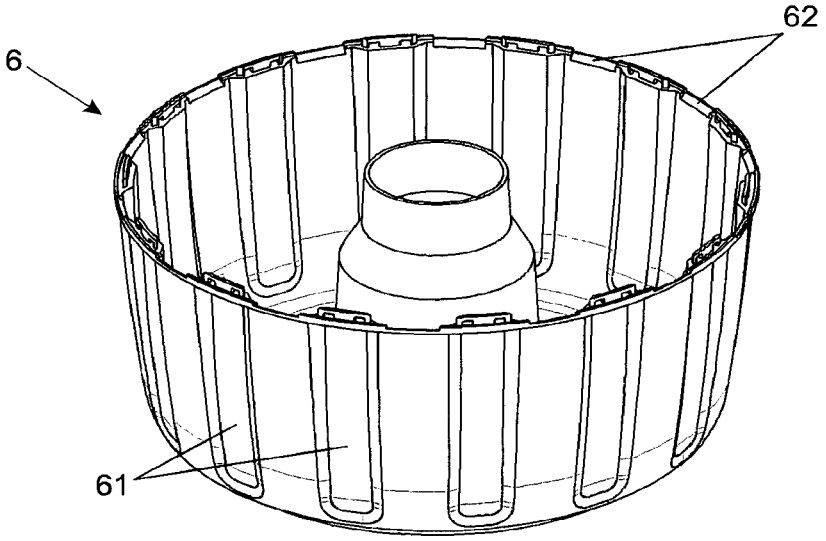
FIG.1.2

COUPLING SYSTEM OF REMOVABLE COMPARTMENT FOR APPLIANCES

CROSS-REFERENCE TO RELATED APPLICATIONS

This application is a continuation of U.S. patent application Ser. No. 14/786,666, filed Oct. 23, 2015, now U.S. Pat. No. 9,863.078, issued Jan. 9, 2018, which is a U.S. National Phase of International Patent Application No. PCT/BR2014/000323, filed on Sep. 9, 2014, and claims priority to Brazilian Patent Application No. BR 10 2013 027400 3, filed on Oct. 24, 2013, all of which are incorporated herein by reference in their entirety.

FIELD OF THE INVENTION

The present invention relates to a coupling system intended, more specifically, to the fitting and attaching of additional and removable internal baskets that define isolated washing rooms in clothes washing machines. Thus, the object of the present invention is to provide a system enabling that the coupling of such elements is in a simpler and more practical manner than those obtained through the use of similar known ones.

BACKGROUND OF THE INVENTION

As is generally known, the clothes washing machines conventionally have a unique washing room defined by mobile basket arranged inside a fixed tank, wherein such mobile basket is usually perforated to allow drainage and spin of the clothes during the washing process.

In the more specific case of the clothes washing machines of vertical axis/upper opening, such mobile baskets are centrally coupled to the stirrer and provided, in the upper edge, of a hydro-balancer ring which keeps the equipment in balance even during the intense movements of centrifugation.

However, it occurs that the existence of only one washing room cause inconvenience to the user, since the white and/or very light clothes cannot be washed with colored clothes at risk of acquiring stains that prevent the their reuse, so that, no matter how small the load of clothes to be washed is, two complete washing cycles are needed to process all the material to be sanitized.

Due to this fact, solutions arose to create independent internal compartments and without fluid communication with the washing room defined by conventional perforated mobile basket, being such rooms therefore able to process the load of white and light-colored clothes while processing colored pieces, thus providing greater practicality and agility to the user. An example of this solution is shown in document U.S. Pat. No. 3,029,623, in which a small washing compartment is coupled to the upper end of the stirrer, but operating in such a way that the water processing the clothes inserted therein is unrelated to the washing water processing the common clothes arranged inside the main tank. However, the coupling to the upper end of the stirrer does not appear very suitable because in addition to keeping the additional washing room only partially arranged within the washing basket, it also has the disadvantage of requiring a higher torque to promote rotation of the stirrer, once it transfers to the stirrer all the weight of the clothes load existing in the inside thereof. Furthermore, mainly during the centrifugation step, both the stirrer and the small washing compartment undergo a very large moment, so that friction between the parts may occur and thus cause wear of the stirrer as well as damage to the axis thereof.

Document U.S. Pat. No. 4,637,231 also discloses the use of an additional washing basket coupled to the stirrer axis, thus incurring the same drawback described in the preceding paragraph.

Analogous solution is presented in document U.S. Pat. No. 4,637,230, which describes a clothes washing machine capable of working with a conventional washing basket (and its respective storage system of water) or a miniature washing basket, which also provides for its own storage tank of water and recirculation system thus disclosing a complex and consequently expensive construction.

Another solution also related to the subject drawbacks is described in document U.S. Pat. No. 3,575,020, which discloses a clothes washing machine integrated by a large washing basket and a small washing basket, both centrally arranged relative to the stirrer axis, wherein the small washing basket is linked to the hydro-balancer ring of the wide washing basket by means of a flange. Thus, it is a solution that requires the use of additional components—in the case, said flange—to provide coupling and fluid seal between the baskets, so that if it occurs a problem in this flange or a possible inappropriate coupling by the user, the fluid communication may occur between the baskets and thus cause stains in the light-colored clothes and inconveniences to the user.

It is noted, therefore, that the current state of the art lacks solutions allowing a safe, efficient and practical coupling of an additional washing basket and fluidly independent with the conventional washing basket of the clothes washing machines of the current state of the art.

OBJECTIVES OF THE INVENTION

Thus, it is one of the objectives of the present invention to provide for a coupling system of removable compartment for appliances that is easy to use by the user.

Another among the objectives of the present invention is to provide for a coupling system that does not require the use of any additional device or component to be effected.

It is still one of the objectives of the invention to provide for a coupling system that does not interfere in the operation of the appliance stirrer, so as not to incur increased torque to drive the stirrer and, thus, does not raise the electricity consumption of the apparatus.

Moreover, one objective of the invention is to provide a coupling form that allows the frequent insertion and removal of the removable internal compartment without this fact may lead, in the short or medium term, to wear able to compromise the sealing and insulation between the washing compartments.

Finally, it is also an objective of the invention to disclose a coupling system of additional washing compartment with a significantly low cost of production and operation, providing the user with the possibility to have an additional function in the equipment thereof without incurring significant increase in the costs of the apparatus.

SUMMARY OF THE INVENTION

The above mentioned objectives are achieved through a coupling system of removable compartment to appliances, more specifically to clothes washing machines comprising a cabinet inside which it is located a fixed tank with which a washing basket, a balancing device, a removable washing compartment and as stirrer element cooperate.

One embodiment of the invention is a washing machine comprising a cabinet inside which is located a tank which cooperates with a washing basket, a balancing device mounted to an upper edge of the washing basket, and a removable washing compartment configured to be mounted on the balancing device. The balancing device includes at least one convex protrusion or at least one concave groove across a portion of an inner side surface, and the removable washing compartment includes the other of at least one convex protrusion or at least one concave groove across a portion of an outer side surface. The balancing device includes a smooth surface portion across a portion of the inner side wall and the removable washing compartment includes a complimentary smooth surface portion across a portion of an outer side surface. When the removable washing compartment is mounted on the balancing device, the smooth surface portion on the inner side wall aligns with the smooth surface portion on the outer surface of the removable washing compartment and the at least one convex protrusion nests with the at least one concave groove such that the surface of the convex protrusion contacts the surface of the concave groove.

BRIEF DESCRIPTION OF THE DRAWINGS

The invention will be described in details based on the figures shown below, in which:

FIG. 1.1 shows, in anterior-superior perspective, the removable inner compartment of a preferred embodiment of the coupling system object of the present invention;

FIG. 1.2 shows an anterior-inferior perspective view of the compartment illustrated in FIG. 1.1;

DETAILED DESCRIPTION OF THE INVENTION

Figure 2:
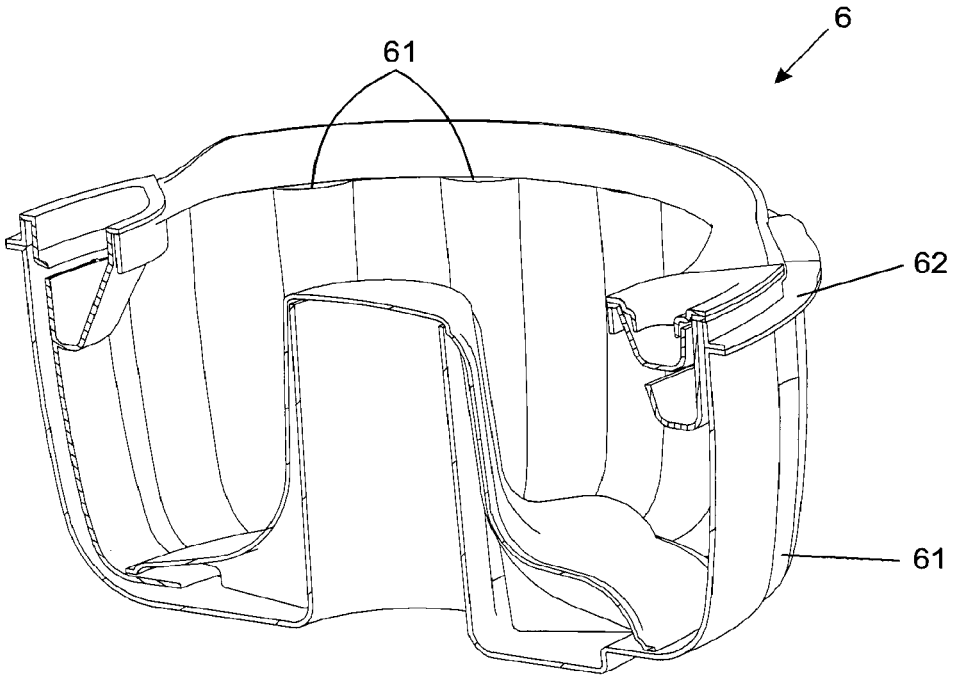
FIG. 2 shows a cross-sectioned perspective view of the compartment illustrated in FIGS. 1.1 and 1.2.

The object of the present invention will be described and explained in more details based on the accompanying drawings, which have merely exemplary and non-limiting character, since adaptations and modifications may be made without thereby escaping from the scope of protection claimed.

The present invention relates to a coupling system of compartments intended to the use in clothes washing machine 1 and more specifically in clothes washing machines of vertical axis/stirrer 7 with access cover located on the upper surface thereof. So basically such appliances comprising a cabinet 2 inside which it is located a generally cylindrical fixed tank 3 which stores the water during the soaking and washing process of the load of clothes to be processed, wherein at the center of the fixed tank 3 it is located the stirrer element 7 internally containing, the rotor axis of the appliance motor (not shown).

In an inner and concentric manner relative to the fixed tank 3, it is coupled a washing basket 4, in the top edge thereof it is usually located a balancing device 5 that is usually presented in the form of a ring containing a particular amount of fluid therein to assist in the balancing of the device during operation—especially to avoid any undue eventual displacement of the appliance during the centrifugation step.

The system object of the present invention also provides for the use of a removable washing compartment 6 which, once coupled inside the washing basket 5, generates an additional and independent washing region from that defined by the basket 5, so that there isn't any type of fluid contact between the two rooms—which enables the simultaneous washing of clothes loads with distinct characteristics that, when there is a unique washing room, could not be processed together under the risk of damaging less favored parts (for example, delicate or white/light colored clothes which, if washed together with colored clothes, acquire irremovable stains).

Considering that the removable washing compartment can be used or not during the processing of a washing load, it is necessary that such a compartment may be easily positioned or removed from the inside of the machine, without that such procedures entail damaging risks to the components of the appliance or risk of occurring fluid contact between the washing zones.

Therefore, the coupling system of removable compartment object of the present invention provides for means to ensure the proper positioning and sealing of the removable washing compartment 6 with the balancing device 5 without demanding, therefore, the need to use additional elements as, for example, flanges, sealing elements or any fastening elements.

Figure 3:
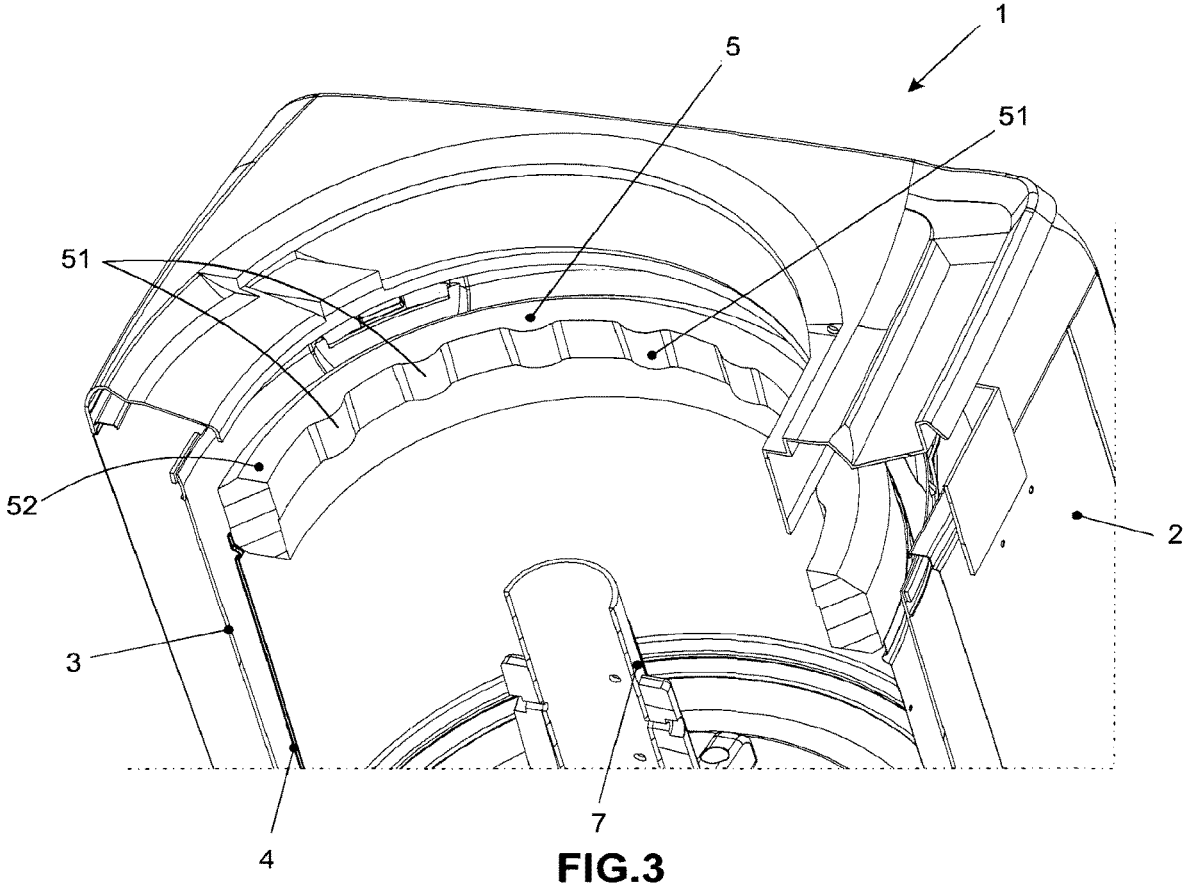
FIG. 3 shows a sectioned perspective view of a clothes washing machine, enabling to view the hydro-balancer ring according to a preferred embodiment of the system object of the present invention.
Figure 4:
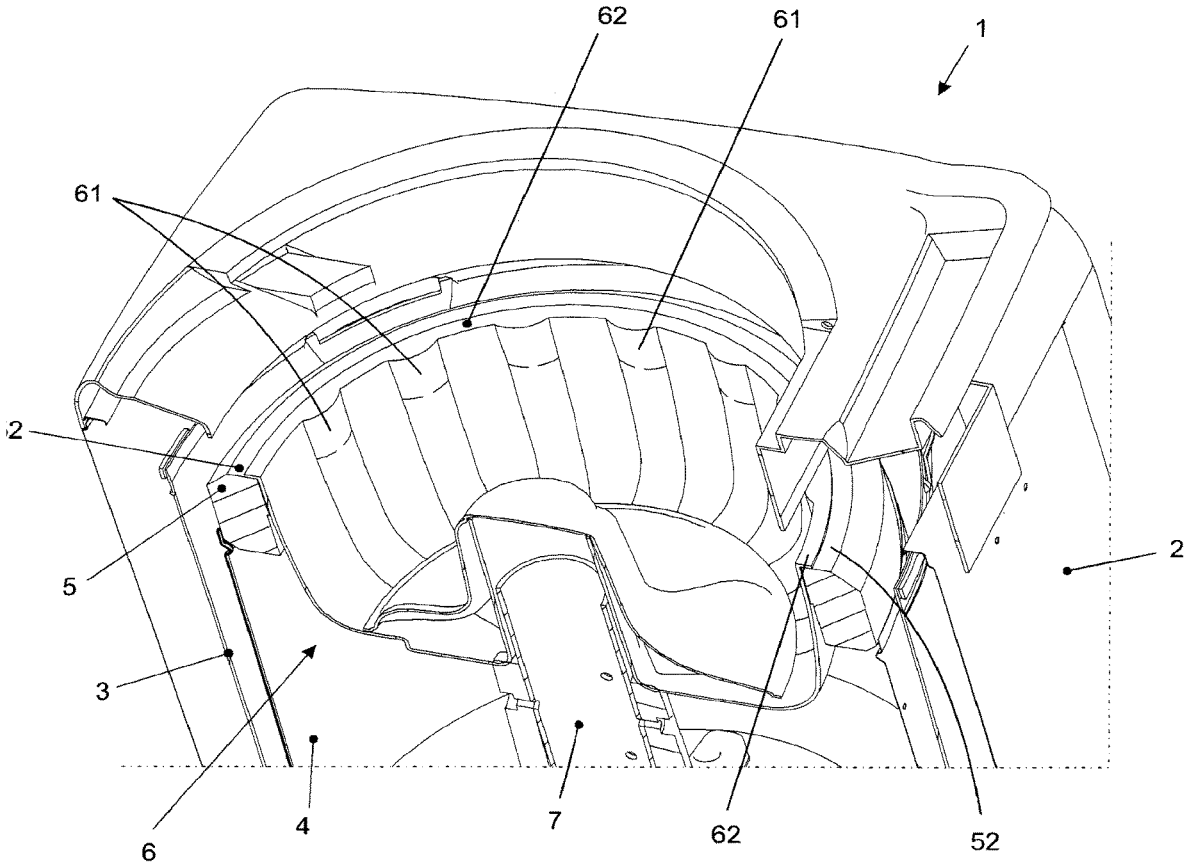
FIG. 4 shows the machine shown in FIG. 3 with the removable inner compartment appropriately coupled to the hydro-balancer ring.
Figure 5:
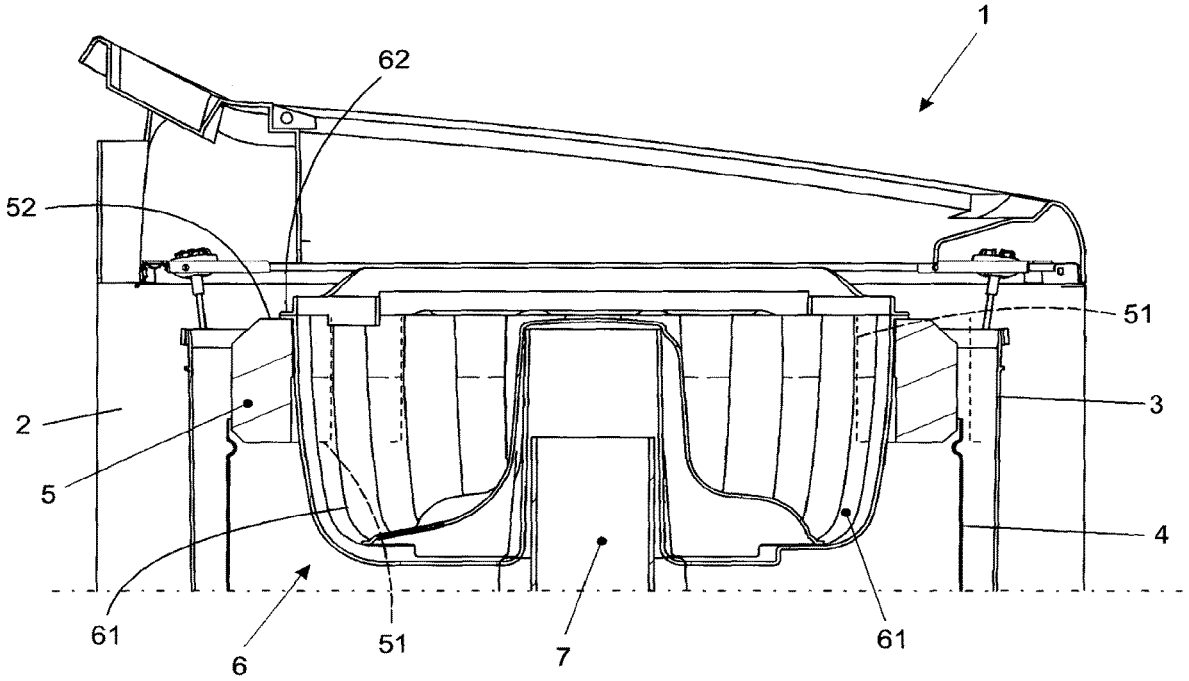
FIG. 5 shows a longitudinal sectional view of the washing machine illustrated in FIG. 4.

Thus, the coupling system of the present invention is characterized by the fact that the balancing device 5 has at least one surface—preferably its inner perimeter surface—comprising a plurality of coupling elements 51 which, in a preferred embodiment of the invention and illustrated in FIGS. 3 and 5, is defined by equally spaced convex protrusions.

In turn, the removable washing compartment 6, which will be coupled to the balancing device 5, contains at least one surface—preferably its outer surface as shown in FIGS. 1, 2, 4 and 5—comprising a plurality of coupling elements 61 preferably defined by concave channels distributed by the surface thereof with the same distance of the coupling elements 51 of the balancing device 5, so that by positioning the removable washing compartment 6 inside the balancing device 5, the channels are automatically coupled to the convex protrusions existing therein, ensuring the proper positioning and attachment between the parts.

It is noteworthy that to assist in the correct positioning between parts 5 and 6 and to ensure the fluid seal between the compartments generated by them, the removable washing compartment 6 will be preferably provided with a flat upper edge 62 which will accommodate over the upper edge 52 of the balancing device 5.

It is also important to explain that in the preferred embodiment illustrated in the accompanying Figures, the balancing device 5 has male type fitting elements while the removable washing compartment 6 has female type fitting elements; however those skilled in the art will certainly understand that balancing device 5 may contain female type elements and the removable washing compartment 6 contains male type fitting elements without departing from the scope of protection claimed here.

Furthermore, it should be informed that, similarly, the cooperation between the coupling elements 51 of the balancing device 5 and the coupling elements 61 of the removable washing compartment 6 can be made by simply coupling, interference or pressure fitting (snap-fit type), or even with the aid of auxiliary fastening elements such as, for example, butterfly type fasteners or the like.

It is noted, therefore, that the coupling system of removable compartment to appliances object of the present invention solves the drawbacks of the current prior art, since they reveal a fitting way which does not interfere with the functioning of the stirrer element 7, does not depend on installation/use of sealing elements (such as flanges, for example), and can be easily removed and coupled by any user, without requiring any kind of technique, knowledge or special procedure to be performed.

Furthermore, it provides constructive advantages, since it does not require substantial changes in the manufacturing processes besides not requiring specific hand labor for installation of sealing means that, until then, are used in similar known systems, thus resulting in significant savings in time and manufacturing cost.

It is also important to highlight that the above description is for the sole purpose of describing in exemplary way some preferred embodiments of the present invention. Therefore, it is evident that the skilled in the art understand that many constructive modifications, variations and combinations of the elements performing the same function substantially in the same way to achieve the same results, are still within the scope of protection defined by the appended claims.

The invention claimed is:

1. A washing machine comprising:

a cabinet inside which is located a tank which cooperates with a washing basket, a balancing device mounted to an upper edge of the washing basket, a removable washing compartment configured to be mounted on the balancing device, wherein the balancing device includes at least one arc shaped convex protrusion or at least one arc shaped concave groove across a portion of an inner side surface, and the removable washing compartment includes the other of at least one arc shaped convex protrusion or at least one arc shaped concave groove across a portion of an outer side surface, and wherein the balancing device includes a smooth surface portion across a portion of the inner side surface and the removable washing compartment includes a complimentary smooth surface portion across a portion of an outer side surface, and wherein when the removable washing compartment is mounted on the balancing device, the smooth surface portion on the inner side surface aligns with the smooth surface portion on the outer surface of the removable washing compartment and wherein the at least one arc shaped convex protrusion and the at least one arc shaped concave groove are complementary arch shapes such that the at least one arc shaped convex protrusion nests with the at least one arc shaped concave groove such that the arced surface of the convex protrusion contacts the arced surface of the concave groove.

2. The washing machine of claim 1 wherein the removable washing compartment further comprises at least one handle.

3. The washing machine of claim 2 wherein the at least one handle is located on an upper perimeter of the wash compartment.

4. The washing machine of claim 3 wherein the smooth portion on the removable wash compartment extends at least around the portion of the wash compartment beneath the at least one handle.

5. The washing machine of claim 3 wherein the smooth portion on the removable wash compartment is adjacent the at least one convex protrusion or at least one concave groove.

6. The washing machine of claim 3 wherein the at least one handle comprises two handles spaced equidistant around the upper perimeter of the wash compartment.

7. The washing machine of claim 6 wherein the smooth portion comprises two smooth portions positioned below the two handles.

8. The washing machine of claim 1 wherein the at least one convex protrusion is positioned about the inner circumference of the balancing device.

9. The washing machine of claim 8 wherein the smooth portion on the inner side surface is on the balancing device.

10. The washing machine of claim 8 wherein a height of the convex protrusions is about the same height as the height of the balancing device.

11. The washing machine of claim 1 wherein the at least one concave groove is positioned on the removable washing compartment.

12. The washing machine of claim 11 wherein the at least one concave groove is positioned about at least a portion of the circumference of the removable washing compartment.

13. The washing machine of claim 11 wherein a height of the concave grooves is about the same height as the height of the removable washing compartment.

14. The washing machine of claim 1 further comprising a stirrer element positioned beneath the removable washing compartment.

15. The washing machine of claim 14, wherein when the removable washing compartment is mounted on the balancing device, the stirrer element does not contact the removable washing compartment.

16. The washing machine of claim 1, wherein the removable washing compartment is provided with a flat lower edge which is configured to be positioned over a flat upper edge of the balancing device.

* * * * *